United States Patent [19]

Grosso et al.

[11] Patent Number: 4,908,301

[45] Date of Patent: Mar. 13, 1990

[54] COLOR-SELF-DEVELOPING, MICROCAPSULAR TONER PARTICLES

[75] Inventors: Paul V. Grosso, West Hartford; Michael J. Morgan, Northford; Feagin A. Wing, Jr., Farmington; Williard F. Burt, Bristol, all of Conn.

[73] Assignee: Olin Corporation, Cheshire, Conn.

[21] Appl. No.: 308,713

[22] Filed: Feb. 10, 1989

Related U.S. Application Data

[63] Continuation-in-part of Ser. No. 171,614, Mar. 23, 1988, Pat. No. 4,869,981.

[51] Int. Cl.[4] ..... G03G 9/08; G03G 13/01

[52] U.S. Cl. ..... 430/45; 430/42; 430/46; 430/47; 430/106; 430/114; 430/137; 430/138

[58] Field of Search ..... 430/42, 45, 46, 47, 430/106, 114, 137, 138

[56] References Cited

U.S. PATENT DOCUMENTS

| | | |
|---|---|---|
| 3,672,935 | 6/1972 | Miller et al. . |
| 3,732,120 | 5/1973 | Brockett et al. . |
| 3,737,410 | 6/1973 | Mueller . |
| 3,832,170 | 8/1974 | Nagamatsu et al. . |
| 3,833,293 | 9/1974 | Serio et al. . |
| 3,838,919 | 10/1974 | Takahashi . |
| 3,854,942 | 12/1974 | Akman . |
| 4,154,610 | 5/1979 | Katoh . |
| 4,200,667 | 4/1980 | Lee et al. . |
| 4,230,495 | 10/1980 | Lee et al. . |
| 4,266,252 | 5/1981 | Cox et al. . |
| 4,294,902 | 10/1981 | Takashima et al. . |
| 4,296,947 | 10/1981 | Spatz et al. . |
| 4,336,067 | 6/1982 | Shackle et al. . |
| 4,356,108 | 10/1982 | Schwab et al. . |
| 4,365,018 | 12/1982 | Crutchfield et al. . |
| 4,399,209 | 8/1983 | Sanders et al. . |
| 4,416,966 | 11/1983 | Sanders et al. . |
| 4,440,846 | 4/1984 | Sanders et al. . |
| 4,447,516 | 5/1984 | Matkan . |
| 4,448,516 | 5/1984 | Arney et al. . |
| 4,482,624 | 11/1984 | Arney et al. . |
| 4,483,912 | 11/1984 | Sanders . |
| 4,501,809 | 2/1985 | Hiraishi et al. . |
| 4,508,807 | 4/1985 | Adair . |
| 4,517,141 | 5/1985 | Dahm et al. . |
| 4,532,183 | 7/1985 | Shackle et al. . |
| 4,532,200 | 7/1985 | Arney et al. . |
| 4,533,615 | 8/1985 | Arney et al. . |
| 4,535,050 | 8/1985 | Adair et al. . |
| 4,536,463 | 8/1985 | Sanders . |
| 4,554,235 | 11/1985 | Adair et al. . |
| 4,562,137 | 12/1985 | Sanders . |
| 4,576,891 | 3/1986 | Adair et al. . |
| 4,578,339 | 3/1986 | Adkins . |
| 4,578,340 | 3/1986 | Saccocio et al. . |
| 4,587,194 | 5/1986 | Adair et al. . |
| 4,592,957 | 6/1986 | Dahm et al. . |
| 4,592,986 | 6/1986 | Nelson et al. . |
| 4,600,678 | 7/1986 | Adair et al. . |
| 4,608,330 | 8/1986 | Marabella . |
| 4,613,742 | 9/1986 | Nelson et al. . |
| 4,622,282 | 11/1986 | Head et al. . |
| 4,636,807 | 1/1987 | Head . |
| 4,647,182 | 3/1987 | Pierce . |
| 4,663,266 | 5/1987 | Adair et al. . |
| 4,675,269 | 6/1987 | Saccocio et al. . |
| 4,699,866 | 10/1987 | Naoi et al. . |
| 4,801,949 | 1/1989 | Misono et al. ..... 430/138 |
| 4,865,943 | 9/1989 | Wright ..... 430/138 |
| 4,876,172 | 10/1989 | Hillenbrand ..... 430/138 |

FOREIGN PATENT DOCUMENTS

| | | |
|---|---|---|
| 2113860 | 8/1983 | United Kingdom . |
| 2133899 | 2/1986 | United Kingdom . |

OTHER PUBLICATIONS

Chemical Week, "Mead Brings Color to Business", Dec. 13, 1987, pp. 32–33.

Chemical and Engineering News, "New Color Technology Uses Microcapsules", Jan. 11, 1988, p. 23.

*Primary Examiner*—Paul R. Michl
*Assistant Examiner*—Jeffrey A. Lindeman
*Attorney, Agent, or Firm*—Dale Lynn Carlson

[57] ABSTRACT

This, invention relates to electrostatic imaging systems, and, more particularly, color-self-developing toner particles and processes for the fabrication and use thereof. A blend of these toner particles is useful in multicolor electrostatic imaging using a single dry or liquid toner bath. Potential applications include full-color xerographic copying, full-color printing, full-color computer-generated imaging, and the like.

13 Claims, No Drawings

COLOR-SELF-DEVELOPING, MICROCAPSULAR TONER PARTICLES

This is a continuation-in-part application of U.S. patent application Ser. No. 171,614, filed Mar. 23, 1988, now U.S. Pat. No. 4,869,981, issued Sept. 26, 1989.

This invention relates generally to electrostatic imaging systems, and, more particularly, to color-self-developing toner particles and processes for the fabrication and use thereof.

Conventional multicolor electrostatic imaging systems utilize a separate toner bath to develop each desired color. This use of separate toner baths is relatively expensive from the standpoint of equipment complexity, cost, maintenance, and processing time expended. It also requires multiple mechanical registrations to produce the multicolor image—a requirement fraught with the potential for error.

As an alternative to the use of toners and electrostatic imaging, a recent development in the industry utilizes an imaging sheet of paper completely coated on one side with microencapsulted color precursors. A portion of the microcapsules on the sheet is selectively hardened by exposure to light. The microcapsules having the desired color precursor in the image areas have liquid cores which remain unhardened. These unhardened microcapsules are then ruptured to release liquid color precursor. The thus-released color precursor is contacted with a color developer to provide the color image, generally by transfer to a developer sheet via pressure contact of the imaging sheet with the developer sheet. Alternately, the color precursor-containing capsules are coated directly on a layer of developer material, which itself had previously been coated on a paper support.

By way of illustration, such a transfer imaging system containing microencapsulated color precursors is disclosed in U.S. Pat. No. 4,554,235, assigned to Mead Corporation. In a variation of this type of system, U.S. Pat. No. 4,501,809, assigned to Mitsubishi Paper Company, disclosed a recording sheet containing two different types of photo- and pressure-sensitive microcapsules—one set containing color precursors and the other set containing color developer. Upon rupture of unhardened microcapsules on the recording sheet after selective exposure of the recording sheet to light in imagewise registration with an image to be copied, a color image is formed on the recording sheet.

The color imaging systems illustrated by the above-cited patents possess a common disadvantage. Both systems utilize an imaging or developer sheet containing microcapsules across a full surface of the sheet. Since in many color image applications the desired color image rarely occupies the full sheet, and, indeed, often occupies less than half of the full sheet, there is a significant amount of waste attributable to the unused microcapsules and associated color precursor and/or developer contained on the non-imaged areas of the sheet. In addition, there is substantial time and energy waste attributable to the need for photohardening the "unused" waste microcapsules using, for example, a scanning laser.

In view of the above, a new toner composition comprising microcapsules, which in use does not require a developer sheet or a separate developer composition and which does not require the coating of the full surface of an imaging sheet in order to utilize the composition, would be highly desired by the color imaging community.

SUMMARY OF THE INVENTION

In one aspect, the present invention relates to a developer-bearing microcapsular toner particle comprising a shell and a core, said shell being fabricated of a polymer, and said core comprising as a color precursor a colorless, chromogenic material, and additionally containing a radiation-sensitive material, said chromogenic material being capable of becoming colored upon contact with a developer, said shell possessing a charge characteristic to render said toner particle electrostatically depositable, said shell having a developer on the outer surface thereof, the shell of said microcapsule being rupturable to release said chromogenic material, thereby contacting and reacting said released chromogenic material with said developer to form a colored image.

In another aspect, the present invention relates to a blend of the above microcapsular toner particles, said blend comprising at least two, but more usually three or four, types of toner particles, each of said types containing a different color precursor (preferably selected from the group consisting of cyan, yellow, magenta, and optionally additionally black), each of said types of particle additionally containing a photosensitive composition that is light-sensitive at wavelengths distinct from the wavelengths of light-sensitivity of the photosensitive composition contained in each of the other types of particles in the blend.

In still another aspect, the present invention comprises a process for making the above developer-bearing microcapsular toner particle which comprises coating a microcapsular toner particle with a color developer, by contacting a microcapsular toner particle with an acidic or complexing developer.

In yet another aspect, the present invention relates to a color imaging method which comprises the Steps of:

(a) forming a latent image on a photoconductive or dielectric substrate, in any of a variety of known manners, for example, by depositing a charge on a photoconductor and imagewise discharging, or imagewise depositing a charge on a dielectric material, (b) electrostatically depositing a blended toner composition onto a charged or uncharged surface of said substrate to form a toned image which is a positive or reverse image as compared to said latent image, said blended toner composition comprising at least two different toners, each of said toners comprising a color precursor contained in photosensitive toner particles, said toner particles containing a developer on the surface thereof, (c) selectively photohardening or photosoftening at least a portion of said toner particles by imagewise exposure to appropriate wavelengths of radiation to provide harder toner particles and softer, rupturable toner particles, (d) transferring said harder toner particles and said rupturable toner particles to a copy surface, and (e) rupturing at least a portion of said toner particles on said copy surface to release color precursor(s) from said rupturable toner particles, thereby contacting and reacting said developer with said released color precursor(s) to form a color image on said copy surface.

In yet another aspect, the present invention relates to a color imaging method which comprises the steps of:

(a) forming a latent image on a photoconductive or dielectric substrate, in any of a variety of known manners, for example, by depositing a charge on a photoconductor and imagewise discharging, or imagewise depositing a charge on a dielectric material, (b) electrostatically depositing a blended toner composition onto a charged or uncharged surface of said substrate to form a toned image which is a positive or reverse image as compared to said latent image, said blended toner composition comprising at least two different toners, each of said toners comprising a color precursor contained in photo-sensitive toner particles, said toner particles containing a developer on the surface thereof, (c) selectively photohardening or photosoftening at least a portion of said toner particles by imagewise exposure to appropriate wavelengths of radiation to provide harder toner particles and softer, rupturable toner particles, (d) rupturing at least a portion of said toner particles on said substrate to release color precursor(s) from said rupturable toner particles, thereby contacting and reacting said developer with said released color precursor(s) to form a color image on said substrate, and (e) transferring said color image to a copy surface.

In yet another aspect, the present invention relates to a color imaging method which comprises the steps of:

(a) forming a latent image on a photoconductive or dielectric substrate, in any of a variety of known manners, for example, by depositing a charge on a photoconductor and imagewise discharging, or imagewise depositing a charge on a dielectric material, (b) electrostatically depositing a blended toner composition onto a charged or uncharged surface of said substrate to form a toned image which is a positive or reverse image as compared to said latent image, said blended toner composition comprising at least two different toners, each of said toners comprising a color precursor contained in photo-sensitive toner particles, said toner particles containing a developer on the surface thereof, (c) transferring said toned image to a copy surface, (d) selectively photohardening or photosoftening at least a portion of said toner particles by imagewise exposure to appropriate wavelengths of radiation to provide harder toner particles and softer, rupturable toner particles, and (e) rupturing at least a portion of said toner particles on said copy surface to release color precursor(s) from said rupturable toner particles, thereby contacting and reacting said developer with said released color precursor(s) to form a color image on said copy surface.

These and other aspects will be readily apparent upon a reading of the following detailed description of the invention.

The toner particle of the present invention is "color-self-developing". The term "color-self-developing", as used herein, is intended to designate a microcapsular toner particle that will form a color upon rupture of the toner particle without the need for any external additives. To form a color image, the microcapsular toner particle is ruptured by any of several means, such as, for example, pressure, onto a surface of a substrate such as a piece of paper, thereby causing release of core material from the toner particle to cause contact between the core material and the developer contained on the external surface of the shell of the particle. Upon contact of this developer with the chromogenic material contained in the core of the toner particle, such as an electron-donating leuco dye, color is formed in the area of the ruptured particle. A desired color image is formed by the selective rupture of a plurality of such toner particles in an appropriate combination to produce the desired color.

Greater detail on a multi-color imaging system using microcapsular toner particles is provided in co-pending, commonly-assigned, U.S. patent application Ser. No. 171,614, filed on Mar. 23, 1988. The composition and processes described in the instant application are suitable for use in conjunction with the system described in Ser. No. 171,614, the disclosure of which is incorporated herein by reference in its entirety.

The toner particles of the present invention afford a simplicity of utilization, particularly with regard to multi-color and full-color imaging systems, that is nowhere afforded by the prior art to the knowledge of the present inventors. More specifically, in contrast to the techniques developed by Mead Corporation and Moore Business Forms which require the use of one or two sheets of specially coated paper or plastic film containing microcapsules and/or developer across the full surface thereof for developing an image, an electrostatic imaging technique associated with the toner particles of the present invention can utilize plain bond paper, rag paper, cardboard, plastic films, or another such substrate. In addition, the toner particle composition possesses a distinct advantage over the prior art, inasmuch as the electrostatically-depositable toner particles carry their own color developer, and are thereby color-self-developing.

As stated above, each individual toner particle comprises a shell and a core. The shell is fabricated from a polymeric material. The shell possesses a charge characteristic to render the toner particle electrostatically-depositable. At a minimum, the core contains a colorless, chromogenic material and a solvent for the chromogenic material. Optionally, the core additionally contains an ethylenically-unsaturated monomer and a polymerization initiator. The polymerization initiator is capable of initiating the polymerization of the monomer under the influence of a specified wavelength of actinic radiation, or heat, or another form of energy. A developer is adsorbed to, coated on, or otherwise bound to the outer surface of the shell of the toner particle.

In order to fabricate the developer-bearing toner particles of the present invention, an aqueous dispersion of minute, microcapsular toner particles is typically combined with an acidic developer or a complexing developer. In a preferred method of fabricating the developer-bearing toner particles, an aqueous solution of citric acid is added to an aqueous dispersion of microcapsular toner particles. The concentration of the toner particles in the aqueous dispersion is generally between about 5 and about 50 percent by weight, preferably between about 5 and about 25 percent by weight, and most preferably between about 10 and about 20 percent by weight. The citric acid is suitably added to provide a citric acid concentration of between about 1 and about 10 percent by weight, preferably between about 3 and about 7 percent by weight, most preferably about 5 percent by weight based upon the total weight of the aqueous dispersion plus the citric acid. The toner particle dispersion is then suitably spray-dried. The product obtained is a dry, free-flowing powder of toner particles wherein each toner particle is coated with citric acid which functions as an acidic developer.

If desired, the dry toner particles produced as described above and containing the developer on the individual microcapsules can be dispersed in a non-polar organic solvent, such as ISOPAR® G or ISOPAR® H, products of Exxon Corporation, preferably in conjunction with other toner additives such as dispersants and/or charge-directing agents, as is known in the art, to provide a liquid reprographic toner composition. When using such a liquid composition, it is preferred that the dispersed particles be in a non-polar organic medium having a low dielectric constant of 3.5 or less and a high electrical resistance of $10^9$ Ohms-centimeters or more. Suitable organic media include the n-paraffin hydrocarbons, cycloaliphatic hydrocarbons, aromatic hydrocarbons, halogenated aliphatic hydrocarbons, and preferably, isoparaffin hydrocarbons, such as the above-mentioned ISOPAR® compounds.

In an alternate embodiment, a dry powder of microcapsular toner particles is suitably coated with a developer as follows. First, dry toner particles are suspended in an organic medium such as tetrahydrofuran (also referred to as "THF") to provide particle concentration of up to about 50 weight percent based upon the total amount of particles plus tetrahydrofuran. A developer, such as citric acid, is then added to the resulting suspension in an amount of between about 0.1 and about 3 percent, preferably about 1 percent, based upon the suspension plus citric acid. The tetrahydrofuran is then removed by evaporation or under vacuum to provide toner particles having a developer on the surface of each particle.

The toner composition useful in the method of the present invention may be a toner blend. This blend contains at least two different types of toner particles in order to provide at least two (preferably at least three or four) different color precursors. As used herein, the term "toner particle" is intended to designate any of a variety of particle forms which can be used to contain or carry and isolate color precursors. Typical examples of particle forms are microcapsules, microsponges, softenable solid particles, and emulsion micelles. A "toner blend" or "blended toner" designates a mixture of different color-forming toner particles which, after deposition and selective hardening, enables multicolor imaging. If full-color imaging capability is desired, three or four (cyan, yellow, magenta, and optionally black) color precursors are typically utilized, each toner particle preferably containing one color precursor and one photoinitiator distinct from the photoinitiators employed with the other color precursors. Other color precursors (e.g., red, green, or blue) can be used as desired. Either a liquid or a dry toner blend can be used.

The method of the present invention provides the above-described advantageous result using a multi-step method of color imaging employing the color-self-developing toner particles of the present invention. In the first two steps, a latent image and then an uncolored, toned image are formed in typical electrostatic fashion on a support, typically a drum, web, or sheet. In the subsequent steps, the desired color is determined by utilizing the photosensitivity differences of the toner particles containing the individual color precursors. These photosensitivity differences are suitably produced by using a different photoinitiator for each separate color precursor employed in the toner blend.

In a typical electrostatic method, the latent image is formed by well known means. First, a blanket positive or negative charge is typically applied to a surface photoreceptor substrate, suitably a photoconductive drum, web, or sheet, by means of a corona. Portions of the surface of the photoreceptor are then selectively discharged. This selective discharge is suitably effected using light (desirably using a laser light source). The surface of the selectively discharged photoconductor contains a latent image on either the charged portions of the surface (for positive development) or on the uncharged portions of the surface (for reversal development). (An alternate method for forming the latent image typically uses an ion-generating cartridge or a charging head ("stylus") to selectively deposit charges on a dielectric substrate to provide charged and uncharged portions of the substrate, as is well known in the art.) Once the latent image has been formed on the photoreceptor, a toner blend having a charge characteristic either opposite from (for positive development) or the same as (for reversal development) the charge on the selectively discharged photoreceptor is then applied onto the surface of the photoreceptor. Typically, the toner blend is applied to the photoconductive surface from a liquid toner bath, or in the case of a dry toner by means of a magnetic brush. A variety of electrostatic development methods is usable and known to practioners of the art. The photosensitive toned image on the photoreceptor is then selectively hardened (i.e., photopolymerized) (or in some embodiments softened, i.e., photodepolymerized) by exposure to radiation of a specified wavelength. This photopolymerization or photodepolymerization is carried out to cause only toner particles containing desired color precursors to be rupturable for releasing said color precursors. For example, if a yellow image is desired, the toned image will be exposed to wavelengths of light which will cause the toner particles containing the cyan, magenta, and black color precursors to be hardened. Likewise if a green image is desired, the toned image will be exposed to wavelengths of light which cause the toner particles containing the magenta and black color precursors to selectively harden. All known colors can be likewise caused to form by exposure of toner particles to the appropriate wavelengths of light and then completing the imaging process. Additionally, the deliberate creation of partially hardened toner particles will give rise to intensity variations of the color produced.

The toned image, composed of both hardened (or harder) and rupturable (or softer) toner particles, is then transferred to a copy sheet by known procedures. For example, this transfer is suitably effected by passing the substrate to be printed, such as a copy sheet of paper or a transparent film, between the photoreceptor and a transfer corona, thereby causing the toner particles to transfer from the photoreceptor to the copy sheet.

Once on the copy sheet, the rupturable toner particles of those making up the toned image are ruptured, typically by radiation, heat, pressure or a combination of these procedures (preferably by pressure) to release the desired color precursors. These desired color precursors are then developed by reaction of the released color precursors with the self-contained developer.

The color precursors useful in the present invention are preferably oil-soluble color formers which will produce a color upon reaction with a developer material in the presence of a carrier oil. Substantially any of the precursors conventionally used in carbonless paper can be used in the present invention. In general, these materials are colorless electron-donating type compounds. Representative examples of such color formers include substantially colorless compounds having in their partial skeleton a lactone, a lactam, a sultone, a spiropyran, an ester or an amido structure. Specifically, there are triaryl-methane compounds, bisphenylmethane compounds, xanthene compounds, thiazine compounds, spiropyran compounds and the like. Mixtures of the respective color precursors can be used if desired.

Some representative leuco dye color precursors which give yellow, cyan, and magenta images are shown below.

Yellow color precursors:

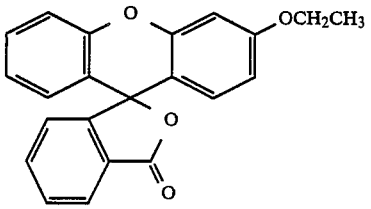

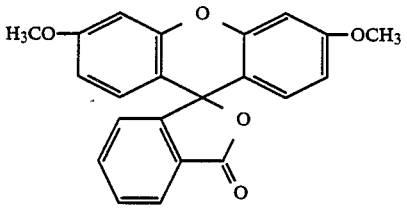

Cyan color precursors:

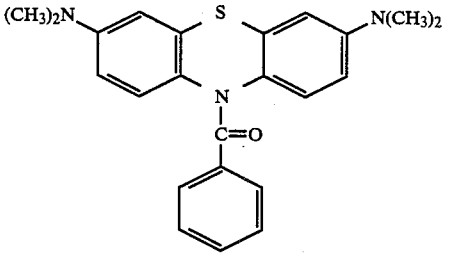

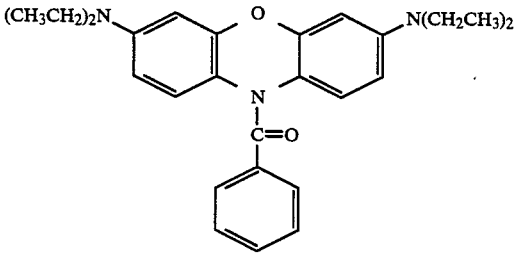

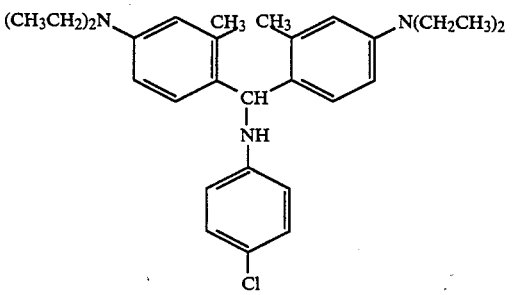

-continued

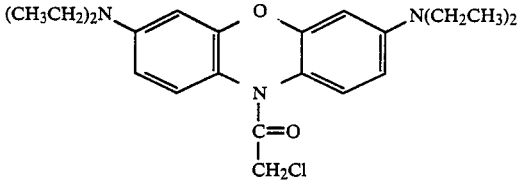

Magenta color precursors:

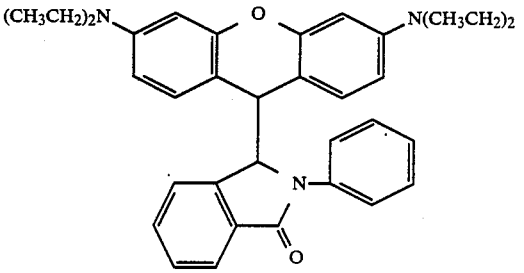

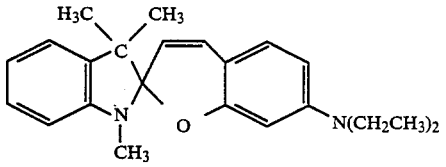

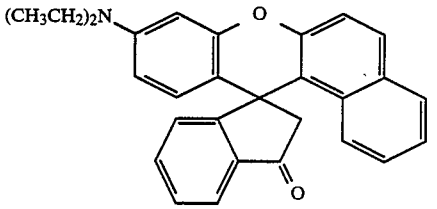

The color precursors used in the present invention must be non-absorbing with respect to the exposure radiations relied upon to cure the photosensitive encapsulate since the color precursors are either present in the encapsulate or the exposure radiation must pass through the color precursor to expose the encapsulate. Hence, colorless electron-donating type compounds are preferred for use in the present invention. Of course, a completely colorless color precursor is difficult to obtain and a small degree of coloration may be tolerated in the color precursor as long as it does not interfere with exposure. Developer materials useful in the present invention include those conventionally employed in carbonless paper technology and are well known. Illustrative specific examples are clay minerals such as acid clay, active clay, attapulgite, etc.; organic acids such as tannic acid, gallic acid, propyl gallate, etc.; acid polymers such as phenol-formaldehyde resins, phenol acetylene condensation resins, condensates between an organic carboxylic acid having at least one hydroxy group and formaldehyde, etc.; metal salts of aromatic carboxylic acids such as zinc salicylate, tin salicylate, zinc 2-hydroxy naphthoate, zinc 3,5 di-tert butyl salicylate; oil-soluble metal salts of phenol-formaldehyde novolak resins (e.g., see U.S. Pat. Nos. 3,672,935; 3,732,120; and 3,737,410) such as zinc-modified oil soluble phenol-formaldehyde resin; and mixtures thereof. Preferred developers are the acid developers. Useful acidic developers include citric acid, oxalic acid, maleic acid, gluconic acid, acrylic acid, methacrylic acid, malonic acid, and the like. Useful complexing developers include the zinc, cobalt, or nickel salts of organic acids such as benzoic acid, napthoic acid, propionic acid, malic acid, and the like.

The location of the developer is not narrowly critical and can vary as long as the developer is carried by the toner particle and separate from the color precursor until release of the color precursor. The developer material may be adsorbed on, bound to, or coated on individual toner particles, giving rise to color-self-developing particles. In another alternative, the developer can be contained inside the toner particles in separate, smaller microcapsules to maintain separation from the color precursor.

The toner particles, comprising what is referred to herein as a "toner blend" or "blended toner", in one preferred embodiment typically have a shell and a core. The core preferably contains the color precursor and the photosensitive composition. The shell is generally positively or negatively charged and can be made of various materials known in the art. The shell contains a developer on the surface thereof. Typical shell materials include, for example, melamine resins, polyurethanes, or urea-formaldehyde resins. The average size of the toner particles is generally between about 0.1 and about 100 microns, preferably between 0.5 and 20 microns. For liquid toners, an average toner particle size is suitably between about 0.1 and about 10 microns whereas a particularly suitable particle size for dry toners is between about 1 and about 20 microns Typically, the core of the toner particles contains photohardenable, photosensitive, radiation-curable, composition(s). The viscosity of the core of the toner particles is increased substantially upon exposure to the appropriate wavelengths of radiation through mechanisms such as crosslinking or polymerization. When the toner particles are ruptured, the photosensitive composition which polymerized upon exposure to radiation will flow very little, if at all, while the unexposed or weakly exposed photosensitive composition can flow relatively freely. As a direct result, the chromogenic material (i.e., the color precursor) reacts with the developer according to the inverse of the degree of exposure to the appropriate wavelength of radiation to form the desired color in the desired image area. Suitable radiation-curable materials include materials curable by free radical-initiated, chain-propagated, addition polymerization or ionic polymerization.

In an alternative embodiment, the photosensitive composition can be a high-viscosity composition which undergoes a substantial decrease in viscosity upon exposure to actinic radiation of the appropriate wavelength. In that case, the chromogenic material located in or on the exposed toner particles, is therefore made accessible to the developer upon rupture of the particles.

Representative photohardenable, photosensitive compositions are ethylenically unsaturated organic compounds. These compounds contain at least one ethylenic group per molecule. Typically they are liquid at room temperature and can also double as a carrier oil for the chromogenic material in the toner core. A preferred group of radiation-curable materials is ethylenically unsaturated compounds having two or more ethylenic groups per molecule. Representative examples of these compounds include ethylenically unsaturated acid esters of polyhydric alcohols such as trimethylolpropane triacrylate or trimethacrylate, acrylate prepolymers derived from the partial reaction of pentaerythritol with acrylic or methacrylic acid or acrylic or methacrylic acid esters; isocyanate-modified acrylate, methacrylic and itaconic acid esters of polyhydric alcohols, etc.

Some typical examples of photosoftenable materials useful in other embodiments are photolysable compounds such as certain diazonium compounds, poly(3-oximino-2-butanone methacrylate) which undergoes main-chain scission upon UV exposure, poly(4'-alkyl acylophenones), and certain resins having a quinone diazide residue.

Photoinitiators are optionally used in accordance with the method of the present invention to selectively photoharden or photosoften the toner particles as desired. The photoinitiator is typically responsive to a specific wavelength and/or amount of actinic radiation. These, alone or in conjunction with a sensitizer, are compounds which absorb the exposure radiation and generate a free radical with or without the aid of coinitiator. If a system which relies upon ionic polymerization is used, the photoinitiator may be the anion- or cation-generating type, depending on the nature of the polymerization. Suitable free radical photoinitiators include alkoxy phenyl ketones, Michler's ketone, acylated oximinoketones, polycyclic quinones, benzophenones, substituted benzophenones, xanthones, thioxanthones, halogenated compounds such as chlorosulfonyl and chloromethyl polynuclear aromatic compounds, chlorosulfonyl and chloromethyl heterocyclic compounds, chlorosulfonyl and chloromethyl benzophenones and fluorenones, haloalkanes, halophenylacetophenones; photoreducible dye/reducing agent redox couples, ketocoumarins, halogenated paraffins (e.g., brominated or chlorinated paraffin) and benzoin alkyl ethers.

If used, the amount of photoinitiator employed in the photosensitive composition to initiate polymerization (i.e., photoharden) or depolymerization (i.e., photosoften) of the photosensitive composition in the toner particles will depend upon the particular photosensitive composition selected, the particular photoinitiator selected, and the photohardening or photosoftening speed desired. The photoinitiator is preferably employed in an amount of between about 0.1 and about 30 (preferably between about 1 and about 10) weight percent based upon the total weight of the toner particles.

Other additives can be employed in the toner particles such as carrier oils, e.g., deodorized kerosene or alkylated biphenyls. Curing agents can also be used. These are free-radical generators such as thermal initiators, which upon reacting with the photosensitive composition cause it to polymerize or crosslink. After selectively exposing the composition to actinic radiation, and rupturing the particles in the presence of a developer material, the chromogenic material and the developer react to produce color in the form of an image, the curing agent then reacts with the released photosensitive composition and hardens it, thereby preventing image diffusion or degradation. In the case of certain curing agents, it may be desirable to heat the image to accelerate the cure. A curing agent is preferably selected which is relatively inactive at room temperature (for good shelf life) and which is readily activated by heating to temperatures in excess of room temperature.

A particularly useful class of thermal initiators reactive with ethylenically unsaturated compounds are organic peroxides. Suitable peroxides include diacyl peroxides, ketone peroxides, peroxydicarbonates, alkyl peroxides, alkyl hydroperoxides and sulfonyl peroxides. Also useful as thermal initiators are bisazides, perborates and diazo compounds.

The method of the present invention is expected to have commercial application in making full-color prints, transparencies and slides, as well as full-color computer-generated images and full-color xerographic copies.

The above-mentioned patents are specifically incorporated by reference in their entirety.

The following examples are intended to illustrate, but in no way limit the scope of, the present invention.

EXAMPLE 1

Aqueous Preparation of Blue-Color-Forming Toner Particles

Blue-color-forming toner particles, which were photosensitive to near-ultraviolet radiation, were prepared in water in the following manner. A solution was prepared by dissolving 5.0 g of ethylene-maleic anhydride copolymer (1:1 mole ratio; 80,000 MW) and 1.0 g of sodium hydroxide in 45.0 g of water with stirring and heating at 90° C. for two hours. Then 100 g of water was added and the solution cooled to 55° C. The pH was adjusted from 4.3 to 4.00 with 10 percent sulfuric acid and the temperature was maintained at 55° C. until the solution was used. The toner core solution was prepared by first mixing 60.14 g of trimethylolpropane triacrylate (TMPTA) and 16.55 g of methyl methacrylate (MMA). To this was added 4.52 g of COPIKEM ® IX (a product of Hilton-Davis), a blue-dye precursor, which was dissolved by heating to 75° C. and strirring. After the dye precursor was dissolved, this solution was allowed to cool to room temperature. Then 5.20 g of Michler's ketone, a UV-sensitive photoinitiator, was added with stirring that was continued until the photoinitiator dissolved. 37.53 g of CYMEL ® 385 (a modified melamine-formaldehyde resin, a product of American Cyanamid) was warmed to about 50° C.

The solution of ethylene-maleic anhydride copolymer was added to a jacketed blender which was heated to 55° C. by means of circulated water. The blender power setting was controlled to 40 volts by means of a variable transformer. Next, the core solution was added and the blender power setting was increased to 90 volts for 45 seconds to disperse the core liquid into small droplets. The blender power was reduced to 40 volts and the CYMEL ® 385 was added to the blender. Stirring and heating at 55° C. were then continued for two hours.

The blue-color-forming toner particles were later isolated as a dry powder by spray drying.

EXAMPLE 2

Spray Drying an Aqueous Suspension of Toner Particles Treated With Citric Acid and Demonstration of Color-Self-Developing Using These Particles 20 ml of an aqueous suspension of magenta-color-forming toner particles containing approximately 20 percent solids was diluted by 50 percent with water. To this was added 1.0 g of anhydrous citric acid. The mixture was stirred for 15 minutes at room temperature to dissolve the citric acid. Next the solution was spray dried and the solids, slightly pink particles, were collected. Scraping or crushing the particles against a sheet of plain paper caused the development of a deep magenta color.

EXAMPLE 3

Preparation of Color-Self-Developing Toner Particles in a Non-Aqueous Medium and Color Development Therewith Another approach to produce color-self-developing toner particles was to dissolve the citric acid in THF (tetrahydrofuran) and add this to the particles along with a dispersant. The system was then diluted with ISOPAR ® G, an isoparaffinic liquid, and the THF was removed by rotary evaporation. A batch of these particles was prepared by treating 0.1 g of particles with five drops of a 1 percent solution of citric acid in THF (1.8 mg citric acid). 0.05 g ZELEC ® UN (an acidic phosphate ester, a product of E. I. du Pont de Nemours & Co.) was also added as a dispersant. The mixture was then diluted with 10 g of ISOPAR ® and the THF was removed. These toner particles were applied to plain paper. After evaporation of the ISOPAR ®, a weighing paper was placed on top of this sheet and pen pressure was applied. This resulted in magenta-colored lines developing on the plain paper.

EXAMPLE 4

Preparation of a Color-Self-Developing Toner Blend and Electrostatic, Photoselective Formation of A Multi-Colored Image Magenta-forming, color-self-developing toner particles and yellow-forming, color-self-developing toner particles were isolated as a powder by spray-drying as in Example 1 or 2. A mixture of spray-dried, color-self-developing toner particles, made up of one part magenta-forming particles and one part yellow-forming particles, was prepared. 3.0 g of a 5 percent ISOPAR ® H solution of SOLSPERSE ® 21000 (a dispersant manufactured by ICI) were added to 1.17 g of the toner particle mixture. 60 g of ISOPAR ® H were added and the entire mixture sonicated to form a dispersion of toner particles. 0.2 g of ZELEC ® UN in 5 mL of ISOPAR ® H isoparaffinic liquid were added, followed by further sonication. The resulting toner particle dispersion was utilized as a toner blend to produce images electrostatically.

A latent image was formed on a piece of dielectric paper (4008-F TM electrographic paper, a product of Versatec, Inc.) using a corona-charging technique. A sheet of MYLAR ® having the letter "O" cut into it was laid on the dielectric paper. A corona connected to a +9000 V power supply was passed over the cut-out region several times, resulting in the formation of a charged area of the paper in the shape of the cut-out "O". The dielectric paper was immersed in the above toner blend for several seconds. The paper, bearing a toned, colorless image was then dried to remove ISOPAR ® H isoparaffinic liquid by briefly placing it in an oven at a temperature of 80° C.

A portion of the toned image was covered by an opaque mask and the paper was exposed to the output of a 100 W BLAK-RAY ® lamp (manufactured by Ultra-Violet Products) for two minutes at a distance of 5 inches. The light was filtered using a long-pass filter that allowed only wavelengths longer than 420 nm to pass (Oriel Corporation, Model #51482). The yellow-forming, self-developing toner particles, containing camphoroquinone (a photoinitiator sensitive to 480±20 nm light) were hardened in the irradiated regions. The magenta-forming, self-developing toner particles were not hardened in either the irradiated or masked regions of the toned image, since these magenta-forming particles contained Michler's ketone as a photoinitiator to make these particles sensitive to 350±40 nm light.

The selectively hardened toned image on the paper was run through a nip roll, after covering the toned image with a piece of weighing paper to prevent toner particles sticking to the rolls during pressure development the final electrostatically produced image was red where it had been shielded from the light (the subtractive combination of magenta and yellow) and magenta where the yellow-forming, self-color-developing toner particles had been hardened by irradiation.

What is claimed is:

1. A developer-bearing, color-self-developing, electrostatically-depositable, microcapsular toner particle comprising a shell and a core said shell being fabricated of a polymer, and said core comprising as a color precursor a colorless, chromogenic material, and additionally containing a radiation-sensitive material, said chromogenic material being capable of becoming colored upon contact with a developer, said shell possessing a charge characteristic to render said toner particle electrostatically-depositable, said shell having a developer on the outer surface thereof, the shell of said toner particle being rupturable to release said chromogenic material, thereby contacting and reacting said released chromogenic material with said developer to form a colored image.

2. The microcapsular toner particle of claim 1 wherein said developer is an acidic developer or a complexing developer.

3. The microcapsular toner particle of claim 1 wherein said developer is an acidic developer selected from the group consisting of citric acid, oxalic acid, maleic acid, gluconic acid, acrylic acid, methacrylic acid, and malonic acid.

4. The microcapsular toner particle of claim 1 wherein said developer is a complexing developer selected from the group consisting of zinc, cobalt, and nickel salts of organic acids.

5. A blend of the microcapsular toner particles as in claim 1 wherein said blend comprises at least two types of toner particles, each of said types containing a different color precursor, each of said types of toner particles additionally containing a photosensitive composition that is light-sensitive at wavelengths distinct from the wavelengths of light-sensitivity of the photosensitive composition contained in each of the other types of particles in the blend.

6. The blend of claim 5 which comprises at least three types of toner particles, each of said types containing a different color precursor selected from the group consisting of cyan, yellow, magenta, and black.

7. A process for making the developer-bearing microcapsular tone particle of claim 1 comprising coating a microcapsular toner particle with a color developer by contacting the microcapsular toner particle with an acidic or complexing developer.

8. The process of claim 7 wherein said contacting is conducted in an aqueous medium, followed by spray-drying to provide dry, developer-bearing microcapsular toner particles.

9. The process of claim 7 wherein said contacting is conducted in an organic medium, followed by removal of the organic medium to provide dry, developer-bearing microcapsular toner particles.

10. The process of claim 8 which additionally comprises dispersing said dry, developer-bearing microcapsular toner particle in a nonpolar organic solvent.

11. A color imaging method which comprises the steps of:

(a) forming a latent image on a photoconductive or dielectric substrate, (b) electrostatically depositing a blended toner composition onto a charged or uncharged surface of said substrate to form a toned image which is a positive or reverse image as compared to said latent image, said blended toner composition comprising at least two different toners, each of said toners comprising a color precursor contained in photosensitive toner particles, said toner particles bearing a developer on the surface thereof, (c) selectively photohardening or photosoftening at least a portion of said toner particles by imagewise exposure to appropriate wavelengths of radiation to provide harder toner particles and softer, rupturable toner particles, (d) transferring said harder toner particles and said rupturable toner particles to a copy surface, and (e) rupturing at least a portion of said toner particles on said copy surface to release color precursor(s) from said rupturable toner particles, thereby contacting and reacting said developer with said released color precursor(s) to form a color image on said copy surface.

12. A color imaging method which comprises the steps of:

(a) forming a latent image on a photoconductive or dielectric substrate, (b) electrostatically depositing a blended toner composition onto a charged or uncharged surface of said substrate to form a toned image which is a positive or reverse image as compared to said latent image, said blended toner composition comprising at least two different toners, each of said toners comprising a color precursor contained in photosensitive toner particles, said toner particles bearing a developer on the surface thereof, (c) selectively photohardening or photosoftening at least a portion of said toner particles by imagewise exposure to appropriate wavelengths of radiation to provide harder toner particles and softer, rupturable toner particles, (d) rupturing at least a portion of said toner particles on said substrate to release color precursor(s) from said rupturable toner particles, thereby contacting and reacting said developer with said released color precursor(s) to form a color image on said substrate, and (e) transferring said color image to a copy surface.

13. A color imaging method which comprises the steps of:

(a) forming a latent image on a photoconductive or dielectric substrate, (b) electrostatically depositing a blended toner composition onto a charged or uncharged surface of said substrate to form a toned image which is a positive or reverse image as compared to said latent image, said blended toner composition comprising at least two different toners, each of said toners comprising a color precursor contained in photosensitive toner particles, said toner particles containing a developer on the surface thereof, (c) transferring said toned image to a copy surface, (d) selectively photohardening or photosoftening at least a portion of said toner particles by imagewise exposure to appropriate wavelengths of radiation to provide harder toner particles and softer, rupturable toner particles, and (e) rupturing at least a portion of said toner particles on said copy surface to release color precursor(s) from said rupturable toner particles, thereby contacting and reacting said developer with said released color precursor(s) to form a color image on said copy surface.

* * * * *